US007183486B2

(12) United States Patent
Pyron et al.

(10) Patent No.: US 7,183,486 B2
(45) Date of Patent: Feb. 27, 2007

(54) LIQUID-TIGHT CONNECTOR WITH DEFORMABLE O-RING

(75) Inventors: Roger Pyron, Bartlett, TN (US); Craig Yoss, Collierville, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 11/486,534

(22) Filed: Jul. 14, 2006

(65) Prior Publication Data

US 2007/0017688 A1 Jan. 25, 2007

Related U.S. Application Data

(60) Provisional application No. 60/701,320, filed on Jul. 21, 2005.

(51) Int. Cl.
*H01R 13/46* (2006.01)

(52) U.S. Cl. ..... 174/59; 174/653; 174/660; 174/662; 174/17.06; 439/583; 285/330

(58) Field of Classification Search ..... 174/59, 174/653, 655–658, 660, 662, 135, 151, 152 G, 174/153 G, 17.06; 439/583, 584, 462, 581; 285/330, 92

See application file for complete search history.

(56) References Cited

U.S. PATENT DOCUMENTS

| | | | | |
|---|---|---|---|---|
| 4,493,522 | A | 1/1985 | Law | |
| 4,547,623 | A | 10/1985 | Van Brunt et al. | |
| 4,549,037 | A | 10/1985 | Bawa et al. | |
| 4,580,865 | A | 4/1986 | Fryberger | |
| 4,599,487 | A | 7/1986 | Blank et al. | |
| 5,301,959 | A | 4/1994 | Gould | |
| 5,310,963 | A | 5/1994 | Kennelly | |
| 5,321,205 | A | 6/1994 | Bawa et al. | |
| 5,648,639 | A | 7/1997 | Hand | |
| 5,763,833 | A | 6/1998 | Bawa et al. | |
| 5,866,853 | A * | 2/1999 | Sheehan | 174/653 |
| 5,882,044 | A * | 3/1999 | Sloane | 285/92 |
| 5,909,903 | A * | 6/1999 | Takahashi et al. | 285/330 |
| 6,034,325 | A * | 3/2000 | Nattel et al. | 174/59 |
| 6,511,337 | B1 | 1/2003 | Fandrey et al. | |
| 6,520,547 | B2 * | 2/2003 | Robinson | 285/330 |
| 6,555,750 | B2 * | 4/2003 | Kiely | 174/657 |
| 6,608,960 | B2 | 8/2003 | Cairns et al. | |
| RE38,294 | E | 11/2003 | Nattel et al. | |

* cited by examiner

*Primary Examiner*—Dhiru R. Patel
(74) *Attorney, Agent, or Firm*—Hoffmann & Baron, LLP

(57) ABSTRACT

A liquid tight connector for terminating one end of an elongate electrical conductor includes a connector body having a rearward conduit receiving end, an opposed forward end and a central bore therethrough. A gland nut is movably secured to the rearward conduit receiving end of the body for securing the end of the conduit thereto and a sealing ring is interposed between the rearward conduit receiving end of the body and the gland nut and is supported within a receiving chamber defined therebetween. The sealing ring has a generally O-shaped cross section and is formed of resiliently deformable material. The gland nut includes an internal frusto-conical surface, which simultaneously urges the sealing ring radially inward toward the conduit and forward toward the rearward conduit receiving end of the body so as to deformably fill the receiving chamber upon the movable securement of the gland nut onto the body.

20 Claims, 3 Drawing Sheets

LIQUID-TIGHT CONNECTOR WITH DEFORMABLE O-RING

CROSS-REFERENCE TO RELATED APPLICATIONS

This application claims the benefit of U.S. Provisional Application No. 60/701,320, filed on Jul. 21, 2005.

FIELD OF THE INVENTION

The present invention relates generally to a connector for terminating an elongate electrical conduit. More particularly, the present invention relates to a connector for terminating an electrical conduit in a liquid-tight connection.

BACKGROUND OF THE INVENTION

Electrical connectors have long been used to terminate and connect electrical conduit to various electrical devices such as motors, panels, junction boxes and the like. The conduit, which may be metallic or non-metallic, typically encloses a plurality of electrical conductors. Quite often, there is a need to terminate such conduit in locations where moisture is present. Such moisture may have a deleterious effect on the wire terminations if the moisture is allowed to track from outside the connector to inside the conduit.

The art has seen a wide variety of connectors which attempt to terminate electrical conduit in a liquid-tight fashion. Typically, these connectors include a body and a gland nut which is screw threaded on the body to secure the electrical conduit in the connector. At the interface between the gland nut and the connector body, a sealing ring is typically interposed. While the sealing ring is positioned to attempt to prevent water and moisture from tracking from outside the connector to inside the connector through the interface between the gland nut and the connector body, these sealing rings have not been entirely effective.

It is, therefore, desirable to provide a connector for terminating electrical conduit which has a sealing ring which effectively seals the interface between the conduit body and the gland nut to achieve a liquid tight connector with the electrical conduit.

SUMMARY OF THE INVENTION

The present invention provides a liquid tight connector for terminating one end of an elongate electrical conductor. The connector generally includes a connector body having a rearward conduit receiving end, an opposed forward end and a central bore therethrough. A gland nut is movably secured to the rearward conduit receiving end of the body for securing the end of the conduit thereto and a sealing ring is interposed between the rearward conduit receiving end of the body and the gland nut and is supported within a receiving chamber defined therebetween. The sealing ring has a generally O-shaped cross section and is formed of resiliently deformable material. The gland nut includes an internal frusto-conical surface, which simultaneously urges the sealing ring radially inward toward the conduit and forward toward the rearward conduit receiving end of the body so as to deformably fill the receiving chamber upon the movable securement of the gland nut onto the body.

In a preferred embodiment, the connector body further includes an annular chamfered surface formed at the rearward conduit receiving end surrounding the central bore. The chamfered surface defines a sealing ring compression space in communication with the receiving chamber, wherein the sealing ring is urged into the compression space upon the movable securement of the gland nut onto the body.

Also, the connector further preferably includes a ground cone insertably received within the central bore and engageable with the conduit for establishing a ground connection between the conduit and the connector body. The ground cone preferably includes a lip received in the sealing ring compression space defined by the chamfered surface of the connector body. The sealing ring presses the lip against the chamfered surface to secure the cone within the connector body and the lip, in turn, provides a biasing force against the sealing ring to enhance the seal against the conduit upon the movable securement of the gland nut onto the body.

The cone further preferably includes a forward base portion, an elongated tubular extension extending rearward from the base portion and an annular sleeve portion extending rearward from the base portion. The annular sleeve portion is disposed radially outward from the tubular extension and terminates at the lip. The base portion abuts against an internal shelf formed inside the connector body when the cone is inserted within the rearward end of the body.

The connector of the present invention can further include an electrically insulative throat insertably received within the central bore at the opposed forward end of the connector body for protecting electrical conductors extending outwardly from the conduit, a locking ring for movable securement to the opposed forward end of the connector body for securing the connector to a panel and a panel sealing ring interposed between the locking ring and the connector body for effecting a seal between the connector body and the panel.

The present invention further involves a method for terminating an end of an electrical conduit within a connector in a liquid-tight manner. The method generally includes the steps of placing a sealing ring around the end of the electrical conduit, forwardly inserting the end of the electrical conduit into a connector body having a rearward conduit receiving end, an opposed forward end and a central bore therethrough for receiving the conduit and movably securing a gland nut to the rearward conduit receiving end of the body for securing the end of the conduit thereto. The sealing ring has a generally O-shaped cross section and is formed of resiliently deformable material and the gland nut includes an internal frusto-conical surface, which simultaneously urges the sealing ring radially inward toward the conduit and forward toward the rearward conduit receiving end of the body so as to deformably fill a receiving chamber defined between the rearward conduit receiving end of the connector body and the gland nut upon the movable securement of the gland nut onto the body.

A preferred form of the liquid-tight connector, as well as other embodiments, objects, features and advantages of this invention, will be apparent from the following detailed description of illustrative embodiments thereof, which is to be read in conjunction with the accompanying drawings.

DESCRIPTION OF THE PREFERRED EMBODIMENT

Figure 1:
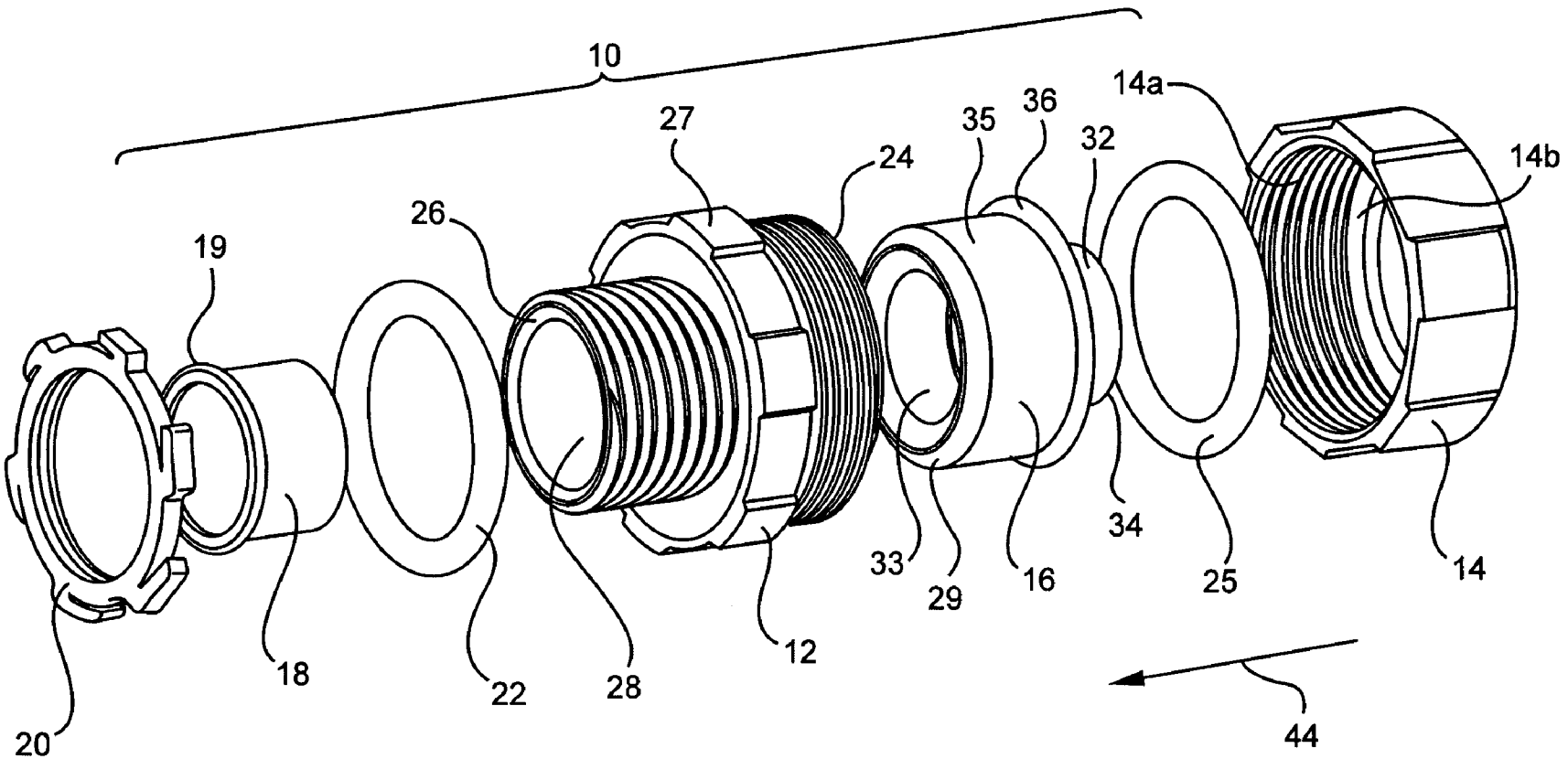
FIG. 1 is an exploded perspective showing of the liquid-tight connector of the present invention.

The present invention provides a connector for terminating one end of a conduit in liquid-tight fashion. Referring to the figures of the present invention, connector 10 is a multi-component element including an elongate connector body 12, a gland nut 14, a ground cone 16, an insulated throat 18, a locking ring 20, a panel sealing ring 22, and a gland nut sealing ring 25.

The connector body 12 is an elongate member having a rearward conduit receiving end 24, a forward conductor egressing end 26, a shoulder portion 27 therebetween and a cylindrical bore 28 therethrough. The forward conductor egressing end 26 is externally screw threaded for receiving an internally screw threaded locking ring 20 for securing the connector 10 to a panel or junction box as is well known in the art. The rearward conduit receiving end 24 of body 12 is also externally screw threaded for receiving internally screw threaded gland nut 14.

Figure 3:
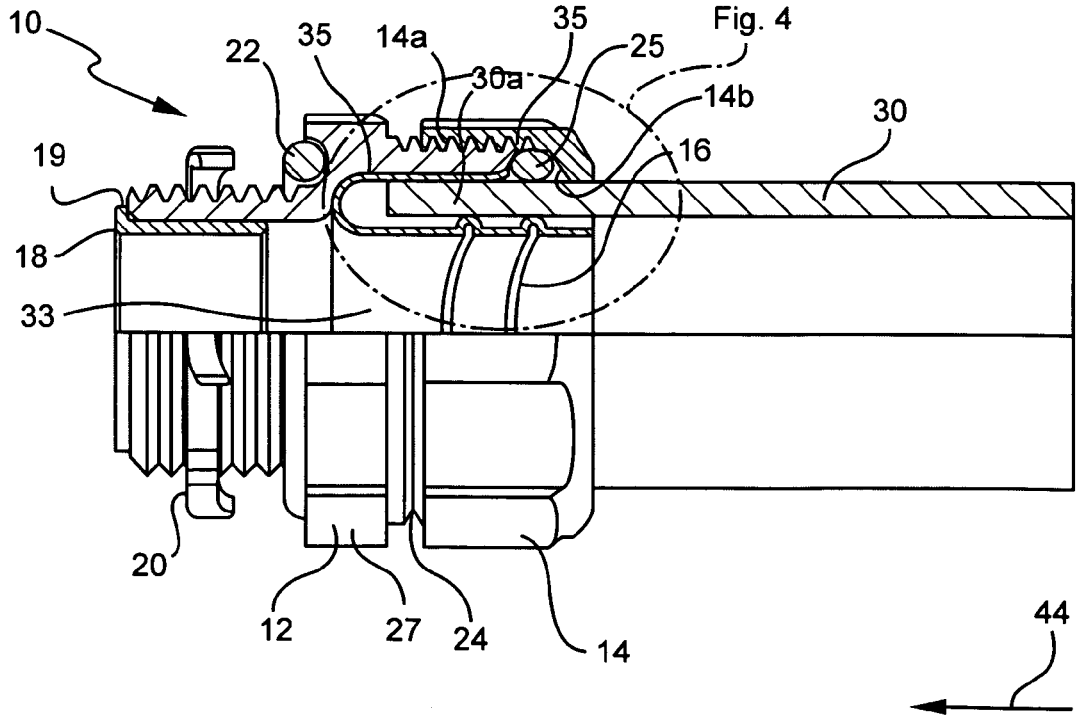
FIG. 3 is a side view, partially in section, of the liquid-tight connector of the present invention terminating an electrical conduit.
Figure 4:
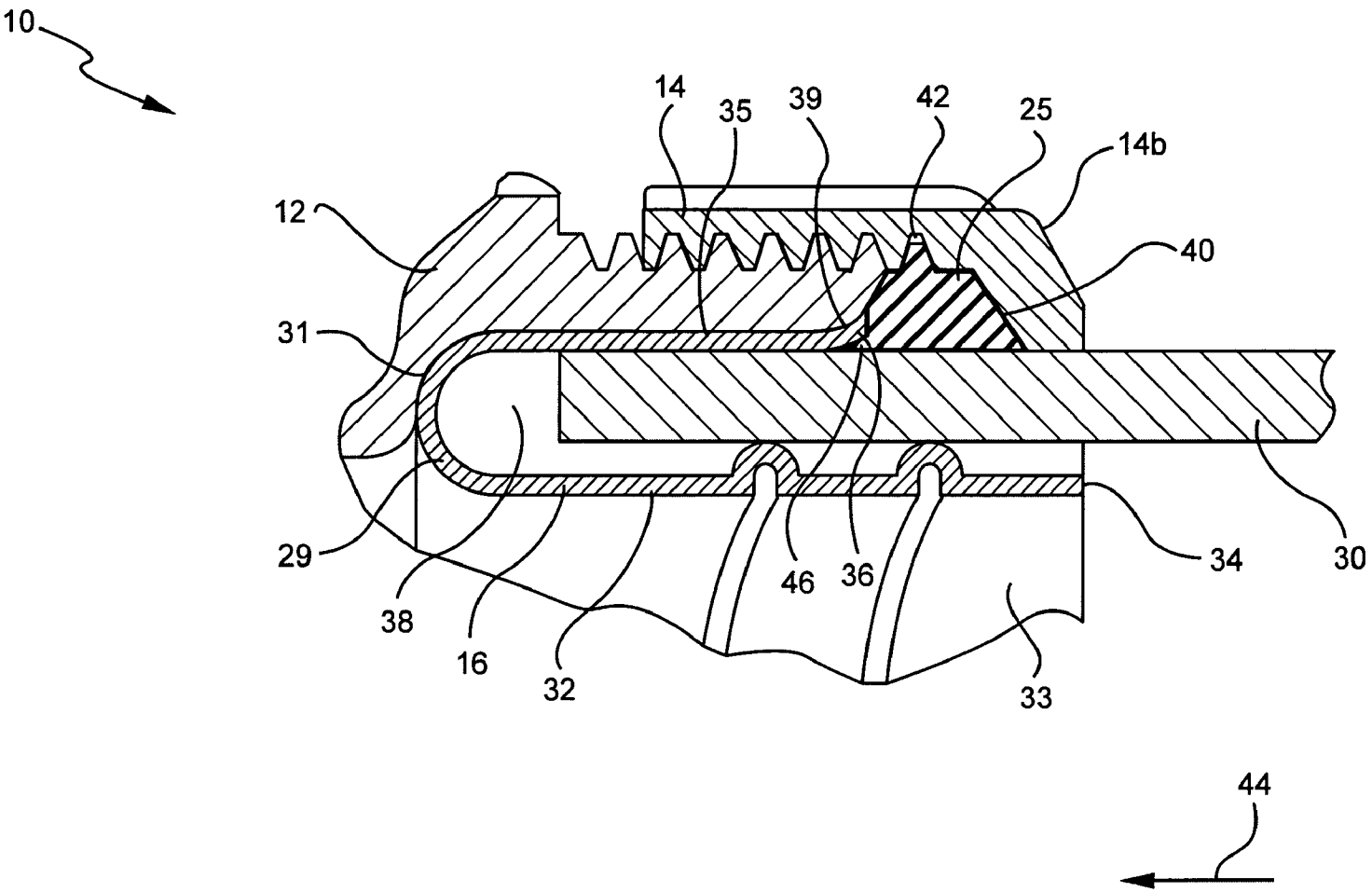
FIG. 4 is an enlarged detailed view of the seal interface of the present invention.

A metallic ground cone 16 is included between gland nut 14 and body 12 to receive one end 30*a* of metallic conduit 30 (FIG. 3). The ground cone 16 includes a forward base portion 29 which abuts against an internal shelf 31 formed inside the connector body 12 when the cone is inserted within the rearward end 24 of the body. The ground cone 16 further includes an elongated tubular extension 32 extending rearward from the base portion 29. The tubular extension 32 defines a cylindrical bore 33 therein and terminates at a rearward conduit insertion end 34. Also extending rearward from the base portion 29 is an annular sleeve portion 35 terminating at a lip 36. The tubular extension 32 extends from within the annular sleeve portion 35 with its conduit insertion end 34 positioned rearward of the lip 36. In this manner, the sleeve portion 35 and the tubular extension 32 of the cone 16 define an annular pocket 38 therebetween for receiving the end 30*a* of the conduit 30, as shown in FIGS. 3 and 4.

Preferably, the lip 36 is formed by bending the forward end of the sleeve portion 35 radially outwardly. When the cone 16 is inserted within the rearward conduit receiving end 24 of the connector body 12, the lip 36 preferably terminates flush with or extends slightly beyond the rearward end 24 of the connector body. In this regard, the conduit receiving end 24 of the connector body 12 is further preferably provided with a chamfered surface 39 at the rearward end of the cylindrical bore 28 to receive the outwardly bent lip 36 of the cone 16. As will be described in further detail herein below, the chamfered surface 39 defines a sealing ring compression space 46 and the outwardly bent lip 36 urges the gland nut sealing ring 25 into this compression space to seal the connector 10.

In a present illustrative embodiment, body 12, ground cone 16, gland nut 14 and locking ring 20 may all be formed of conductive metal so that electrical continuity is established between metallic conduit 30 and the connector body as well as the panel (not shown) to which connector 10 is secured. While metallic components are preferably shown so as to terminate metallic conduit, the present invention also contemplates the termination of non-metallic electrical conduit.

Insulated throat 18 is inserted within the forward conductor egressing end 26 of body 12 so as to provide protection for the electrical conductors (not shown) extending outwardly therefrom. The insulated throat 18 preferably includes a radially outwardly extending circumferential lip 19 at a forward end thereof, which abuts against the conductor egressing end 26 of the connector body 12. A conventional sealing ring 22 is interposed between the locking ring 20 and body 12 so as effect a seal between the connector body 12 and the panel to which connector 10 is attached.

The present invention further provides an improved sealing ring 25 which is supported between the rearward conduit receiving end 24 of the connector body 12 and the gland nut 14.

Figure 2:
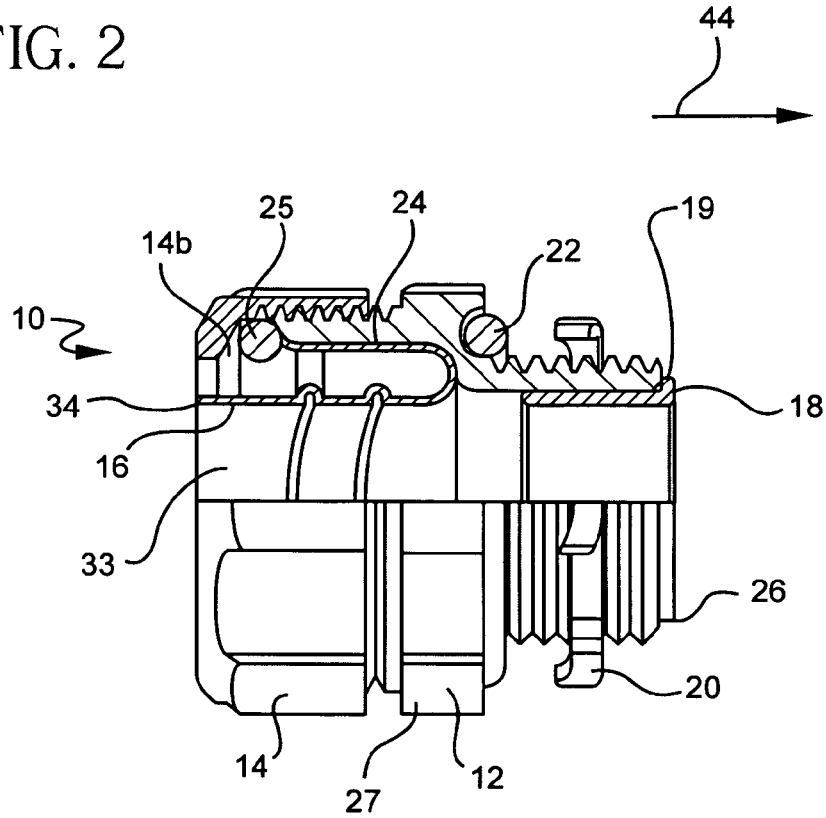
FIG. 2 is a side view, partially in section, of the assembled liquid-tight connector of the present invention.

Referring additionally and more specifically to FIGS. 2–4, gland nut 14 includes a forward end 14*a* which is internally screw threaded and a rearward end 14*b*, which includes a tapered, frusto-conical internal surface 40. Upon screw attachment of gland nut 14 onto the conduit receiving end 24 of body 12, a chamber 42 is defined between the tapered internal surface 40 of the rearward end 14*b* of the gland nut 14 and the end 24 of connector body 12. This chamber 42 compressively receives sealing ring 25.

In the present illustrative embodiment, sealing ring 25 has a cross-section which is generally O-shaped and is formed of materials which has enhanced flexibility and elastic properties. Preferably, the sealing ring 25 may be formed of pliable elastomeric materials such as, but not limited to synthetic and thermoplastic rubbers such as Neoprene, as well as Buna-N, Nitrile and Viton. The deformability and elastic properties of sealing ring 25 allow the sealing ring to fill and conform to the chamber 42 created between gland nut 14 and body 12 upon attachment thereto.

Specifically, upon threading the gland nut 14 to the connector body 12, the internal frusto-conical surface 40 of the gland nut simultaneously urges the sealing ring 25 radially inward toward the outer surface of the conduit 30 and forward, along the direction of arrow 44, toward the rearward end of the connector body 12, as shown in FIG. 4. In this manner, the sealing ring 25 deforms to fill chamber 42 defined between the tapered internal surface 40 of the rearward end 14*b* of the gland nut 14 and the end 24 of connector body.

Furthermore, as the gland nut 14 is movably secured to the connector body 12, the sealing ring is further urged into the sealing ring compression space 46 defined between the rearward chamfered surface 39 and the outer surface of the conduit 30. As the sealing ring 25 fills this space, it presses the lip 36 of the cone 16 against the chamfered surface 39, thereby locking the cone 16 into the connector body 12. The outwardly bent lip 36 of the cone 16 further provides a biasing force against the sealing ring 25 to enhance the seal. This compression and deformability of the sealing ring 25 places the sealing ring in compressive engagement with the conduit 30 thereby providing an effective and enhanced seal among the connector body 12, gland nut 14 and conduit 30.

This seal is liquid-tight in nature and prevents moisture from tracking from the outside of connector 10 to the inside of conduit 30. Moreover, the flexibility of sealing ring 25 allows easy installation over conduit 30 due to the ability of the flexible sealing ring to stretch over the irregular surface of conduit 30. Moreover, it is further contemplated that the sealing ring 25 may be formed from a pliable elastomer of the type which is commonly available in retail outlets so that if the sealing ring 25 is lost or damaged it can be easily replaced without any need to replace the entire connector. Also, it is preferable for sealing ring 25 to be of softer material than the outer jacket of conduit 30 so as not to abraid or otherwise diminish the protective and sealing qualities of such jacket. Because sealing ring 25 has higher ductility than this jacket, sealing ring is better able to conform to any exterior surface irregularities of the jacket. Further, by sealing ring 25 being as flexible as it is and by conforming to chamber 42, connector 10 can now provide a liquid-tight seal even if gland nut 14 is submerged. This is due to sealing ring 25 sealing both around the perimeter of conduit 30 as well as the receiving end 24 of connector body 12.

Various changes to the foregoing described and shown structures will now be evident to those skilled in the art. Accordingly, the particularly disclosed scope of the invention is set forth in the following claims.

What is claimed is:

1. A liquid-tight connector for terminating one end of an elongate electrical conduit comprising:

a connector body having a rearward conduit receiving end, an opposed forward end and a central bore therethrough;

a gland nut for movable securement to said rearward conduit receiving end of said body for securing said one end of said conduit thereto, said gland nut including an internal frusto-conical surface; and a sealing ring interposed between said rearward conduit receiving end of said body and said gland nut and supported within a receiving chamber defined therebetween, said sealing ring having a generally O-shaped cross section and being formed of resiliently deformable material, wherein said internal frusto-conical surface of said gland nut simultaneously urges said sealing ring radially inward toward said conduit and forward toward said rearward conduit receiving end of said body so as to deformably fill the receiving chamber upon said movable securement of said gland nut onto said body.

2. A connector as defined in of claim 1, wherein said sealing ring is formed from a pliable elastomer.

3. A connector as defined in claim 1, further including a ground cone insertably received within said central bore at said rearward conduit receiving end of said connector body and engageable with said conduit for establishing a ground connection between said conduit and said connector body.

4. A connector as defined in claim 1, wherein said connector body further includes an annular chamfered surface formed at said rearward conduit receiving end surrounding said central bore, said chamfered surface defining a sealing ring compression space in communication with said receiving chamber, wherein said sealing ring is urged into said compression space upon said movable securement of said gland nut onto said body.

5. A connector as defined in claim 4, further including a ground cone insertably received within said central bore and engageable with said conduit for establishing a ground connection between said conduit and said connector body, said ground cone including a lip received in said sealing ring compression space defined by said chamfered surface of said connector body.

6. A connector as defined in claim 5, wherein said sealing ring presses said lip against said chamfered surface to secure said cone within said connector body upon said movable securement of said gland nut onto said body.

7. A connector as defined in claim 5, wherein said lip of said cone provides a biasing force against said sealing ring to enhance the seal against said conduit upon said movable securement of said gland nut onto said body.

8. A connector as defined in claim 5, wherein said ground cone further comprises a forward base portion, an elongated tubular extension extending rearward from said base portion and an annular sleeve portion extending rearward from said base portion, said annular sleeve portion disposed radially outward from said tubular extension and terminating at said lip.

9. A connector as defined in claim 8, wherein said cone base portion abuts against an internal shelf formed inside said connector body when said cone is inserted within said rearward end of said body.

10. A connector as defined in claim 8, wherein said lip is a radially outwardly bent portion of said annular sleeve portion.

11. A connector as defined in claim 1, further comprising an electrically insulative throat insertably received within said central bore at said opposed forward end of said connector body for protecting electrical conductors extending outwardly from said conduit.

12. A connector as defined in claim 11, wherein said insulative throat includes a radially outwardly extending circumferential lip at a forward end thereof for abutting against said opposed forward end of said connector body.

13. A connector as defined in claim 1, further comprising a locking ring for movable securement to said opposed forward end of said connector body for securing said connector to a panel and a panel sealing ring interposed between said locking ring and said connector body for effecting a seal between said connector body and the panel.

14. A connector as defined in claim 1, wherein said rearward conduit receiving end of said connector body and said gland nut include cooperating screw threads for providing said movable securement therebetween.

15. A connector as defined in claim 1, wherein said connector body further includes a shoulder portion disposed between said rearward conduit receiving end and said opposed forward end for engagement with an installation tool.

16. A method for terminating an end of an electrical conduit within a connector in a liquid-tight manner comprising the steps of:

placing a sealing ring around the end of the electrical conduit, said sealing ring having a generally O-shaped cross section and being formed of resiliently deformable material;

forwardly inserting the end of the electrical conduit into a connector body having a rearward conduit receiving end, an opposed forward end and a central bore therethrough for receiving the conduit; and movably securing a gland nut to said rearward conduit receiving end of said body for securing the end of the conduit thereto, said gland nut including an internal frusto-conical surface, wherein said internal frusto-conical surface of said gland nut simultaneously urges said sealing ring radially inward toward said conduit and forward toward said rearward conduit receiving end of said body so as to deformably fill a receiving chamber defined between said rearward conduit receiving end of said connector body and said gland nut upon said movable securement of said gland nut onto said body.

17. A method as defined in claim 16, wherein said connector body further includes an annular chamfered surface formed at said rearward conduit receiving end surrounding said central bore, said chamfered surface defining a sealing ring compression space in communication with said receiving chamber, and wherein said sealing ring is urged into said compression space upon said movable securement of said gland nut onto said body.

18. A method as defined in claim 17, wherein said conduit insertion step comprises the step of forwardly inserting the end of the electrical conduit into a ground cone insertably received within said central bore and engageable with said conduit for establishing a ground connection between said conduit and said connector body, said ground cone including a lip received in said sealing ring compression space defined by said chamfered surface of said connector body.

19. A method as defined in claim 18, wherein said sealing ring presses said lip against said chamfered surface to secure said cone within said connector body upon said movable securement of said gland nut onto said body.

20. A method as defined in claim 18, wherein said lip of said cone provides a biasing force against said sealing ring to enhance the seal against said conduit upon said movable securement of said gland nut onto said body.

* * * * *